United States Patent [19]

Bonacina

[11] 4,014,478

[45] Mar. 29, 1977

[54] SECURITY WINCH FOR DIVERS

[76] Inventor: Jean-Claude Bonacina, 42 Rue Arson, 06 300 Nice, France

[22] Filed: Feb. 13, 1975

[21] Appl. No.: 549,825

[30] Foreign Application Priority Data

Feb. 18, 1974 Monaco ..... 10931001

[52] U.S. Cl. ..... 242/107; 9/14; 242/107.2

[51] Int. Cl.² ..... B65H 75/48

[58] Field of Search ..... 242/107–107.15, 242/107.2; 9/14

[56] References Cited

UNITED STATES PATENTS

| | | | |
|---|---|---|---|
| 3,122,340 | 2/1964 | Gentile | 242/107.11 |
| 3,224,706 | 12/1965 | Bastow | 242/107.13 |
| 3,317,936 | 5/1967 | Johnson et al. | 242/107 X |

*Primary Examiner*—Stanley N. Gilreath
*Assistant Examiner*—John M. Jillions

[57] ABSTRACT

A winch adapted to be secured to a buoy including a drum having a hollow shaft journalled at its ends, for rotation around its longitudinal axis. An elastic band is stretched through the drum and is fixed at one end to one end of the shaft and at the other end to a housing surrounding the drum. A line is wound about the drum which when played out rotates the drum about the longitudinal axis and places the elastic band under torsion, giving the drum a predetermined elastic rotatable bias.

3 Claims, 1 Drawing Figure

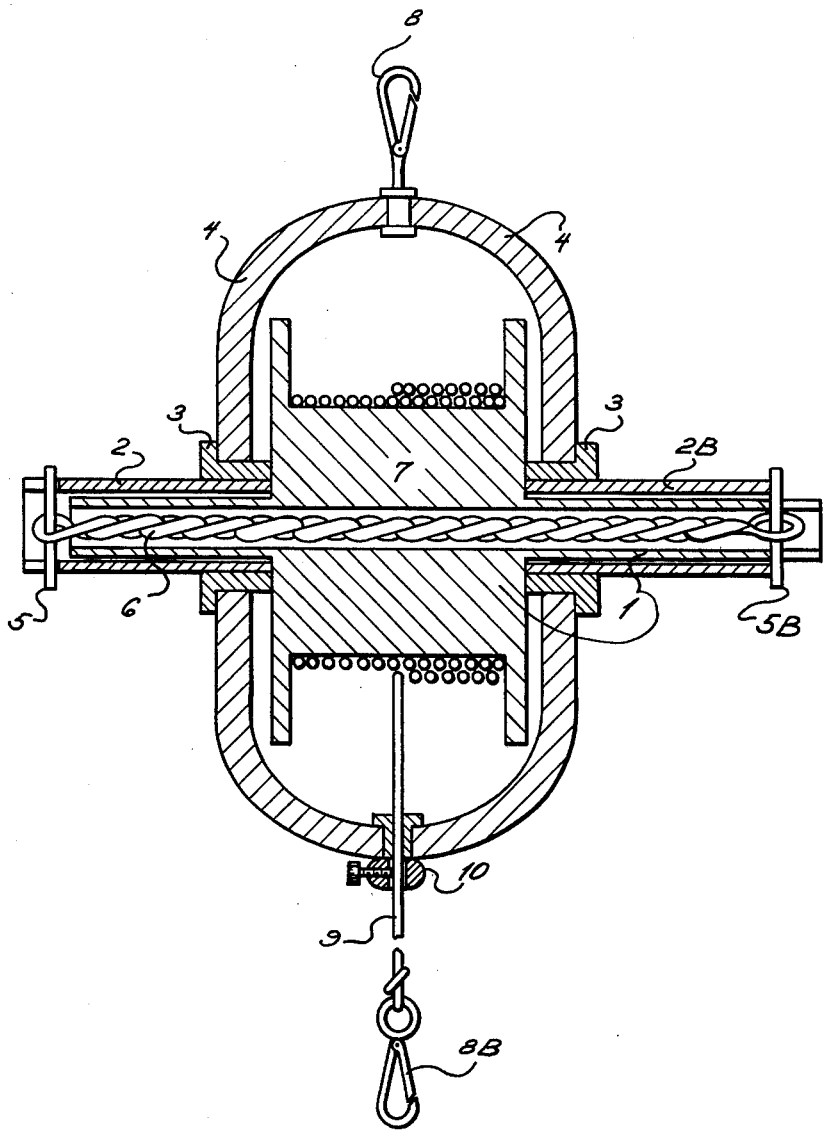
8
4
4
3
3
2
2B
7
6
1
5
5B
10
9
8B

SECURITY WINCH FOR DIVERS

The invention relates to a security winch attachable to a single buoy required by law to mark and continuously follow the position of a swimmer or a diver.

In deep sea, swimmers, hunters and/or divers are often exposed to accidents caused by various uncontrollable incidents and/or by their own indisposition. If anything like this occurs, as is well known, security guards have to intervene within the shortest delay possible. Sometime, a diver whose precise position is unknown may happen not to be observable to, or may be so entrained in the ocean current or waves that he be carried out without the life guards observing or locating him.

It is the object of the invention to obviate and eliminate these danger by providing means continuously marking the position of a submarine swimmer or diver. The swimmer or diver, according to the invention, is connected by a light cable or rope to a signal buoy, the cable or rope being controlled in a manner such that it does not interfere with, or hamper the free movements of the swimmer or diver and does not get in the way of a free departure at a substantial distance from the buoy. In effect thereof, the position of the swimmer or diver is continuously known and establishable irrespective of what might have happened.

The arrangement according to the invention includes a buoy easily observable due to its shape and color supporting a winch arranged to automatically wind and unwind a light rope which uninterruptedly ties the swimmer or diver to the buoy without the necessity of any intervening operation. The winch includes a drum having a hollow shaft located at its ends within bearings which are firmly positioned in corresponding openings provided in a housing encapsulating the winch for protecting it against outer influences. The assemblage of the drum and its housing forms a unit provided with a snap-hook for suspension to the buoy. Another snap-hook is provided at the end of the rope extending through an aperture in the housing to the outside of the winch. By means of this second snap-hook, the swimmer or diver attaches himself to the rope of the winch, wherethrough he is then attached to the buoy.

Through the hollow space within the shaft of said drum, a bundle of elastic threads is led which threads may be made of natural or synthetic caoutchouc. This bundle is attached at one end thereof to one end of the hollow shaft wherethrough it is led, while it is attached at its other end to a tubing opposed to the place where its other end is affixed to said hollow shaft.

The light rope may be made of a synthetic material, such as polyamide, the mechanical properties whereof are well known in the art. The rope is wound upon said drum, so that it extends by one of its ends through said aperture from the housing of the winch. At or near this aperture a locking stopper is arranged enabling the swimmer or diver to limit the possible withdrawal of the rope from the winch in order to comply with official regulations determinative of the permitted distance from the marking buoy.

When the winch is suspended on the buoy and the rope is hung on the swimmer or diver's belt, each increase in the swimmer or diver's distance from the buoy provokes a free unwinding of the rope from the drum. Thus the drum is forced to revolve, whereby the bundle of elastic threads is subjected to rotational tension and becomes twisted. When thereafter, during the swimmer or diver's return toward the buoy the traction of the rope descrease or stops, the bundle of the elastic threads is untwists to its untensioned and untwisted condition thus rotating the drum in the direction opposite to that of the rope unwinding so that the light rope is withdrawn from outside and wound upon the drum. This automatic return of the light rope into the winch obviates any danger of formation of curlings or loops upon the rope and thus prevents the danger that the swimmer or diver could be anyhow hampered in his freedom of motion.

The accompanying drawing displays an examplary embodiment of the invention. In same, the buoy has not been illustrated since it is well known in the art.

In the drawing, a drum 7 having a hollow shaft 1 is shown rotatably located in, and supported by a pair of opposite guiding tubes 2 and 2B. The drum 7 is arranged on said shaft and is integral therewith and has wound upon it a determined length of rope 9. The housing 4 is composed of two mirror image cap-shaped parts. Each of the guiding tubes 2 and 2B is frictionally held within a bushing 3 controllable with respect to each other to adjust the position of the drum within the housing to secure its free play therein. Through the interior of the hollow shaft 1, a bundle of elastic threads 6 is located. This bundle is kept in position at the one terminal thereof by a latching pin 5 abutting the end of one of the guiding tubes 2 being stationary in the housing. Said bundle is kept in position at the other terminal thereof by a latching pin 5B abutting the terminal of said rotatable hollow shaft 1. Being arranged in the way explained, the bundle 6 is stationarily kept at one of its terminals, while being rotated at its other terminal when the drum is revolved by unwinding the rope 9. This unwinding rotation sets said bundle under torsional stress and causes its twisting. This imparts to the bundle enough energy to automatically revolve the drum back when the pulling force ceases to be exerted on the rope. The use of the latching pins 5 and 5B makes it possible to prewind the bundle for in order to put it under a prestress enhancing its force exerted upon the drum.

On the housing 4 of the winch, a snap-hook 8 is located serving for attachment to the buoy. In the housing, an aperture is provided for the light rope permitting it to be drawn out of the winch. At the outside free end of said rope, another snap-hook 8B is affixed serving for attachment to the swimmer or diver's belt. The rope 9 may be made of polyamide or from another material having similar strength properties. An adjustable locking stopper 10 is located on the rope, exterior of the buoy by which the swimmer or diver may adjust the maximum distance he does not want to exceed free of the buoy. This stopper is arranged to permit free movement of only a given distance without energizing the winch.

The subject matter of the invention is utilizable in connection with all the maneuvers performed by a person on or under the water level. However, the winch provided by the invention is appropriate to be used in particular as an equipment for submarine swimmers, sea-hunters and divers.

The bundle of thread may in fact be a plurality of separate elastic members, such as rubber or the like, twisted or braided together. The pin 5 passes through a radial slot or hole in the guide tube or sleeve 2, while the pin **5*b* passes through a similar slot or hole in the shaft 1 and slidingly abuts against the frontal end of the tube 2***b* so that when the elastic band 6 is twisted the pin 5*b* is compressed against the end of the shaft allowing the band to transmit energy directly to the drum for an automatic winding of the line 9. The bushings 3 are laterally adjustable on the tubes 2 and 2b relative to the housing so as to act to space the drum 7 from the walls of the housing.

I claim:

1. A winch comprising a housing having means for securement to a buoy, a drum located within said housing, a pair of hollow tubes extending outwardly of said housing along an aligned axis, a movable bushing interposed between said hollow tubes and said housing having an inner end engaging said drum, said bushings being axially adjustable relative to each other to position said drum within said housing, said drum having a hollow central shaft freely journalled concentrailly within the tubes, one end of said shaft extending outwardly of one tube, the other end of said shaft terminating within the other tube, an elongated line secured at one end to the drum and wound about its surface, the other end of said line extending out of said housing, a continous annular elastic band arranged along the axis of said hollow shaft, a first slot formed at the one end of said shaft extending from the associated tube, a pin received in said slot passing through the elastic band in engagement with said tube, a second slot formed in the tube adjacent the other end of said shaft, a pin received in said second slot and passing through said elastic band, thereby fixing said band to said housing, said drum being free movable on winding or unwinding of said line to torsionally bias said elastic band by a pull on said line providing motive power for the automatic return of said drum on release of said line.

2. A winch according to claim 1 wherein said elastic band comprises a plurality of threads.

3. A winch according to claim 1 including means for limiting the winding of said line on said drum.

* * * * *